United States Patent [19]

McKean

[11] Patent Number: 4,819,519

[45] Date of Patent: Apr. 11, 1989

[54] AUTOMATIC STUD DRIVER HAVING THREAD RELIEF FOR HIGH TORQUE APPLICATIONS

[75] Inventor: John A. McKean, Fairview, Pa.

[73] Assignee: Titan Tool Company, Fairview, Pa.

[21] Appl. No.: 151,559

[22] Filed: Feb. 2, 1988

[51] Int. Cl.[4] ..... B25B 19/00

[52] U.S. Cl. ..... 81/53.2

[58] Field of Search ..... 81/53.2, 459; 29/254; 411/427, 466, 436, 437; 409/66, 76; 82/1 C, 5, 5.5; 407/24, 120

[56] References Cited

U.S. PATENT DOCUMENTS

| | | | |
|---|---|---|---|
| 3,161,090 | 12/1964 | Mclellan | 81/53.2 |
| 3,793,912 | 2/1974 | Bilz | 81/53.2 |
| 4,371,354 | 2/1983 | McKean | 464/36 |
| 4,470,329 | 9/1984 | McKean | 81/53.2 |
| 4,476,749 | 10/1984 | McKean | 81/53.2 |
| 4,513,643 | 4/1985 | McKean | 81/53.2 |
| 4,590,826 | 5/1986 | McKean | 81/53.2 |
| 4,688,315 | 8/1987 | Jannke | 81/53.2 |
| 4,724,730 | 2/1988 | Mader | 81/53.2 |

OTHER PUBLICATIONS

Robert O. Parmley, P.E., Standard Handbook of Fastening and Joining, "Threaded Fasteners—Descriptions and Standards", pp. 22-27, 1977.

*Primary Examiner*—Frederick R. Schmidt
*Assistant Examiner*—Blynn Shideler
*Attorney, Agent, or Firm*—Parkhurst, Oliff & Berridge

[57] ABSTRACT

A stud driver has threaded jaws with thread relief provided on a leading edge area of the jaws to reduce thread marking or deformation of the thread on the stud when the stud is driven under high torque conditions. The thread relief in the leading edge area of the jaws creates a shallower angle and increases contact area. If the stud driver is subjected to unusually high torques, the increased contact area prevents shearing of the thread on the stud.

16 Claims, 4 Drawing Sheets

AUTOMATIC STUD DRIVER HAVING THREAD RELIEF FOR HIGH TORQUE APPLICATIONS

BACKGROUND AND SUMMARY OF THE INVENTION

The present invention relates to a high torque automatic stud driver. More particularly, the present invention relates to a stud driver having threaded jaws with thread relief provided on a leading edge of the jaws to reduce the likelihood of thread marking or thread deformation of the thread on the stud when the stud is driven under high torque conditions.

Automatic stud drivers are known in which a stud is rotated to thread or screw it into a workpiece. Such automatic stud drivers include a plurality of jaws which automatically clamp a stud once the stud is inserted in the driver, thread the stud into a workpiece, and then automatically release the stud without the requirement that the stud be unthreaded from the jaws of the driver. For example, see U.S. Pat. Nos. 4,513,643; 4,590,826; 4,476,749; 4,470,329 and 3,793,912. These known automatic stud drivers are most satisfactory under normal torque conditions i.e., torques that do not exceed the formula $T=KDL$ where T is torque in inch pounds; K is the torque coefficient; D is the nominal stud diameter in inches; and L is the clamp load objective. Under normal torque conditions, the known stud drivers rotate the stud into the workpiece without damage to the threads on the portion of the stud clamped between the jaws.

However, under high torque conditions where the torque exceeds the torque in the aforementioned equation, the applicant discovered that damage or deformation occurs to the threaded portion of the stud clamped within the jaws. Such "thread marking" is undesirable from both an appearance standpoint and mechanical standpoint since thread markings disrupt the thread profile of the stud projecting from the workpiece, often to a degree wherein the thread becomes useless i.e., a subsequent item cannot be fully or easily threaded onto the portion of the stud projecting from the workpiece.

Accordingly, it is an object of the invention to provide an automatic stud driver which reduces the likelihood of thread marking under high torque conditions.

To achieve this and other objects, the present invention is directed to a stud driver in which the threads of the jaws are modified to adapt to high torque conditions. In particular, the applicant discovered that the thread markings occur on the stud at a portion corresponding to the location of the leading edge of the jaws when the stud is grasped by the jaws. Applicant discovered that the leading edge of the jaw tends to cut into the underside of the thread on the stud due to the small contact area and high stress. To relieve this stress, the present invention provides thread relief in a leading edge area of the jaw to create an increased contact area on the leading edge area of the jaws. Under high torque conditions, the shallower angle and increased contact area allow the leading edge of the jaw to approach the stud, without shearing or deforming the threads on the stud.

In a preferred embodiment, the automatic stud driver includes a plurality of stud gripping and rotationally driven jaws, each of the jaws having a leading edge area and a trailing edge area with reference to the rotational direction of the jaws. The plurality of jaws form a substantially cylindrical assembly having a central longitudinal axis. A transverse cross-section of each jaw defines an arc of a circle having a thread center point located along the central longitudinal axis. The thread center point also defines an intersection of first and second mutually orthogonal transverse axes, one of the transverse axes centrally dividing the arc into the leading edge area and trailing edge area.

Each of the jaws has an internal thread with a predetermined radius R1 originating from the thread center point. The leading edge area of each of the jaws has thread relief with a radius R2 originating from a thread relief center point located at a distance b from the thread center point in a direction away from the trailing edge of the jaw. In accordance with the preferred embodiment, the radius R2 is equal to about 75–150% of R1, and the distance b is equal to about 20–50% of the radius R2. In a preferred embodiment, the relief center point is located at a distance b from the thread center point in a direction away from the trailing edge of the jaw along a bisector of the first and second mutually orthogonal transverse axes.

BRIEF DESCRIPTION OF THE DRAWINGS

The present invention will be described with reference to the appended drawings in which like reference numerals refer to like elements and wherein.

DETAILED DESCRIPTION OF THE PREFERRED EMBODIMENTS

Figure 1:
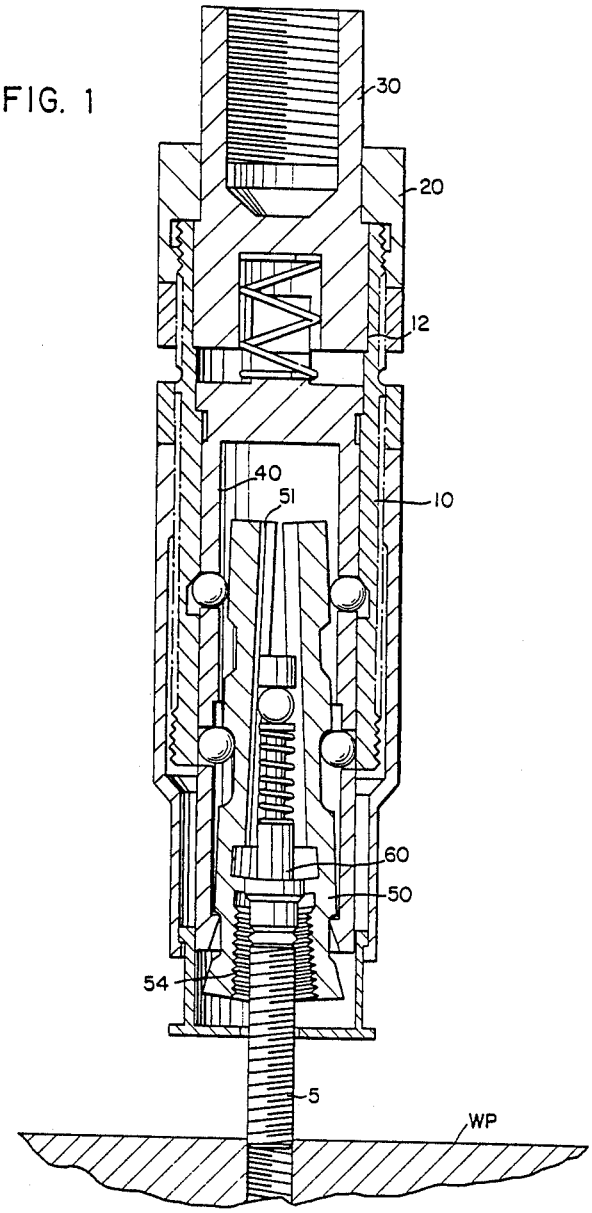
FIG. 1 is a side view of a representative stud driver.

To summarize the operation of a typical stud driver, FIG. 1 illustrates a exemplary stud driver of the type disclosed in U.S. Pat. No. 4,513,643, the disclosure of which is herein incorporated by reference. The stud driver includes a cylindrical body 10 having an internal cylindrical body cavity 12, a driven head 30 disposed within the cavity 12 of the body 10, and a collar 20 which is threadably secured to the body 10 for maintaining the driven head 30 within the body 10. A cylindrical carriage 40 rotates within the body cavity 12 and is capable of limited axial movement therein between an upper position where it is engaged for rotation with the driven head 30, and a lower position in which it is disengaged from the driven head 30. An assembly of jaws 50 reciprocates within the carriage 40, each jaw preferably being semi-cylindrical with a thread corresponding to that of a stud 5 to be driven into the workpiece WP. While two jaws 50 of 180° each are illustrated, the invention is applicable to a stud driver with two or more jaws (e.g. three jaws of 120° each). Each jaw 50 includes a semi-cylindrical groove 51 extending for the axial length of each jaw. The lower section of the groove 51 includes a threaded section 54. A plunger mechanism 60 is located between the jaws 50 for moving the jaws 50 between an open lower position and a closed upper position, the plunger mechanism being spring-biased to urge the jaws toward the open lower position.

In the initial position illustrated in FIG. 1, the jaws 50 are open and the stud 5 is inserted until the head of the stud contacts the plunger mechanism 60. Further movement of the stud 5 against the plunger mechanism 60 moves the plunger mechanism 60 upward to retract the jaws 50 within the carriage 40, and the carriage 40 within the body 10, thus requiring the jaws 50 to pivot to the closed position in which the threaded portions 54 of the jaws 50 are clamped about the stud 5. Continued retraction of the carriage 40 within the body 10 eventually engages the carriage 40 with the driven head 30 to rotate the carriage 40 and the jaws 50, which in turn rotates the stud 5 into the workpiece WP and advances the body 10 toward the workpiece WP. When the body 10 is prevented from further advancement, threading of the stud 5 into the workpiece WP draws the carriage 40 downward out of engagement with the driven head 30. When the stud driver is pulled away from the workpiece WP, the jaws 50 are pulled downward from the carriage 40, thus allowing the jaws to pivot to the open position and release the stud 5. The operation is repeated for the next stud. While the invention is applicable to the stud driver in U.S. Pat. No. 4,513,643, it is also applicable to any internally threaded tool and other stud drivers including those disclosed in U.S. Pat. Nos. 4,590,826; 4,476,749; 4,470,329 and 3,793,912, the disclosures of which are also herein incorporated by reference.

When the stud 5 is clamped by the jaws 50 and rotated into the workpiece under normal torque conditions, the thread on the portion of the stud projecting from the workpiece (corresponding to the portion of the stud clamped by the jaws) is not deformed. Normal torque conditions depend on the material from which the stud is constructed (e.g., metal), and the quality of the thread on the stud and are defined by the equation $T=KDL$. If the thread on the stud is not deformed, a subsequent item can be easily screwed onto the projecting portion of the stud to fasten that item to the workpiece.

However, applicant discovered that the rotation of the stud into the workpiece under high torque conditions can deform the thread profile of the stud, thus inhibiting the thread performance and the ability of the stud to accept a subsequent item to be screwed on to the stud. While high torque conditions also depend on the material from which the stud is constructed and the quality of the thread, high torque conditions are values for torque which exceed the equation T=KDL. In addition, applicant discovered that the thread deformation or thread marking occurs at the leading edge area of the jaws, the leading edge being the front edge of the jaw in the direction of rotation, and the trailing edge being the rear edge of the jaw which follows the front edge during rotation. Applicant also discovered that thread marking may occur at only one location on the stud (corresponding to the leading edge of one jaw) or on opposite sides of the stud (corresponding to the leading edge of each of two jaws) usually depending on the flatness of the head of the stud which engages the plunger 60. For example, if the head of the stud is flat, thread marking usually occurs on opposite sides of the stud due to the leading edges of both jaws. If the head is slanted so that the plunger is not flush with the head of the stud, thread markings usually occur on only one location on the stud corresponding to the leading edge of one jaw.

Applicant believes that the rotation of the jaws under high torque conditions causes the jaws to become off-centered so that the leading edge of one or both jaws presses against the stud more than the trailing edge of the jaws. Such excess pressure at the leading edge area of the jaw is believed to cause the thread marking. To relieve excess pressure, applicant discovered that providing thread relief in the leading edge area of the jaw to create a recess between the leading edge area and the stud eliminates thread marking. It is believed that under high torque conditions, the recess provides greater contact area on the leading edge area of the jaws, thus permitting greater torque to be applied to the stud before the thread on the stud starts to shear.

Figure 2:
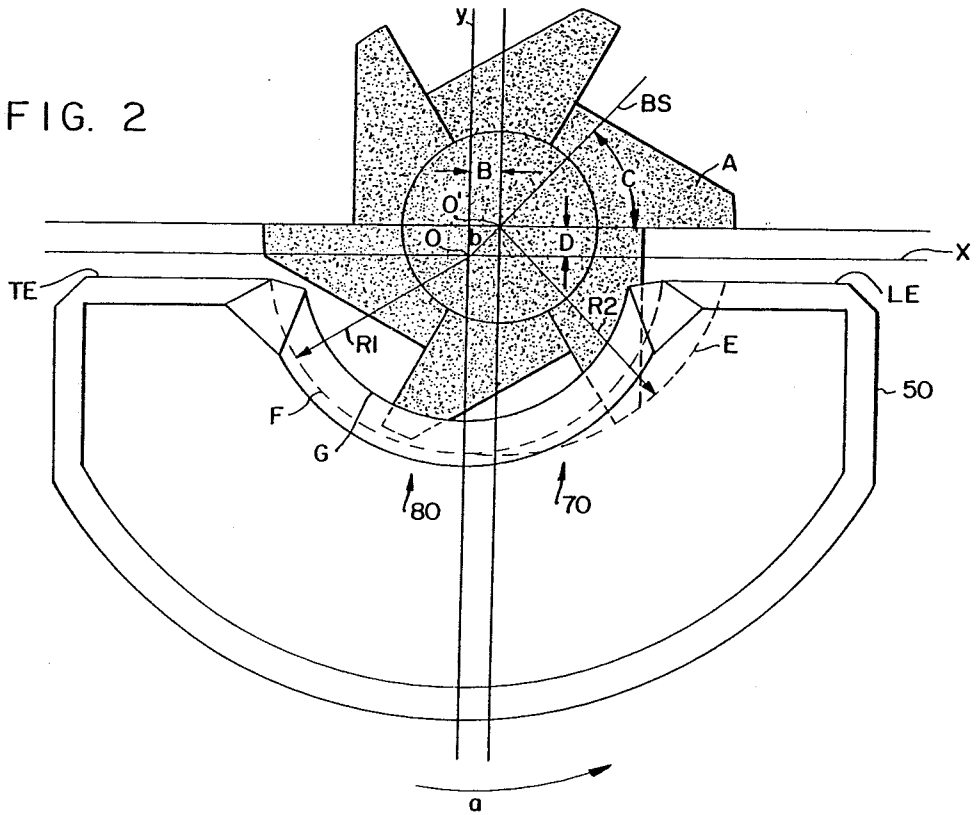
FIG. 2 is a bottom longitudinal view of one jaw of the stud driver of FIG. 1.

FIG. 2 illustrates the thread relief on one semi-cylindrical jaw 50. Since the jaw rotates in the direction of arrow a, the leading edge LE of the jaw 50 is adjacent to front edge of the jaw in the direction of arrow a, while the trailing edge TE is adjacent the rear edge. The semi-cylindrical groove 51 of the jaw 50 is provided with the threaded portion 54 by a tap (not shown) whose center is located at a thread center point O. The thread center point O of the thread is located along a central longitudinal axis of the jaw. Moreover, the thread center point O defines the intersection of two transverse axes, a horizontal axis X and a vertical axis Y which are mutually orthogonal and lie in a plane perpendicular to the central longitudinal axis. The vertical axis Y centrally divides the jaw into a leading edge area 70 and a trailing edge 80.

The thread formed by the tap has a major diameter F and a minor diameter G. A radius R1 equal to half the tap size extends from the thread center point 0 to the line F representing the major diameter of the thread.

To provide thread relief in the leading edge area 70, a cutter A is located in the threaded portion 54 of the jaws. The cutter A has a radius R2 equal to half the cutter size. The radius R2 originates at a thread relief center point O' which corresponds to the center of the cutter A when the cutter A is positioned to remove material from the thread at the leading edge area of the jaw. The radius R2 defines an arc E which represents the outer edge of the thread relief, i.e., the material removed from the threads in the leading edge area of the jaw.

From experiments conducted by applicant, applicant discovered that the likelihood of thread marking is most reduced when R2 approximates between 75–150% of R1, so that:

$$R2=(0.75 \text{ to } 1.5)\times R1 \quad (1)$$

Preferably R2 is about 115% of R1 so that:

$$R2=1.15\times R1 \quad (2)$$

The thread relief center point 0' or the center of the cutter A must be offset by a distance b from the center O of the tap in order to provide relief in the leading edge area. Moreover, the distance b by which the center of the cutter O' is offset from the center of the tap 0 should be in a direction away from the trailing edge area of the jaw i.e., in the upper right hand quadrant Q of FIG. 2 defined by the positive sections of the transverse axes X, Y. Preferably, the distance b is measured along a bisector BS of the axes X,Y. That is, if the bisector BS is located at an angle C of 45° between the axis X and Y, then the center of the cutter 0' is located by moving a lateral distance B along the axis X and an equal vertical distance D along the axis Y, the distances B and D being in the direction away from the trailing edge area and determined by geometric relationships to be:

$$B = \sqrt{\frac{b^2}{2}} \quad (3)$$

$$D = \sqrt{\frac{b^2}{2}}$$

From experiments conducted by applicant, it has been determined that the distance b should be in the range of about 20–50% of R2 so that:

$$b = (0.2 \text{ to } 0.5) \times R2 \quad (4)$$

Preferably, b is 21.2% of R2 so that:

$$b = 0.212 \times R2 \quad (5)$$

The location of the center of the cutter O′ along the bisector BS is employed to simplify the fixation point for the cutter since the cutter is moved an equal distance laterally and vertically from the thread center point O. However, the center of the cutter O′ need not be limited to a point along the bisector BS. For example, with small cutters, the angle C may be decreased to about 0° to position the cutter at a distance b along the axis X so that the cutter is located close to the leading edge of the jaw. For large cutters, the angle C may be increased to about 60° and the distances B and D recalculated for a 60° angle. The determining factor for the location of the center of the cutter or the thread relief center O′ is to provide thread relief in the leading edge area within the range specified by equation 1. It has been discovered by applicant that thread relief in the trailing edge area has no effect on thread marking and only serves to weaken the jaw. Accordingly, the distance b by which the center of the cutter (or thread relief center O′) is offset from the center of the tap (or thread center point O) should be in a direction away from the trailing edge area of the jaw i.e., in the positive quadrant Q of the transverse axes X, Y.

Examples of thread relief obtained by the invention are set forth below:

EXAMPLE I

Figure 3:
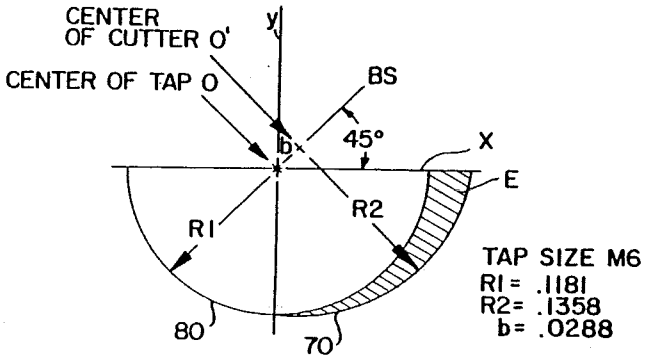

As illustrated in FIG. 3, a thread was formed in a semi-cylindrical jaw using an M6 tap size to form a thread with radius R1=0.1181 inches. In accordance with equations (2) and (5), the radius R2 for thread relief is 0.1358 inches (equal to 1.15×R1) at a distance b along the bisector BS equal to 0.288 inches (equal to R2×0.212). The cutter employed has a size twice that of the radius R2. The thread relief E was accomplished in the leading edge area of the jaw. In operation, no thread marking was evident when the jaw was used to screw a stud into a work-piece under high torque conditions.

EXAMPLE II

Figure 4:
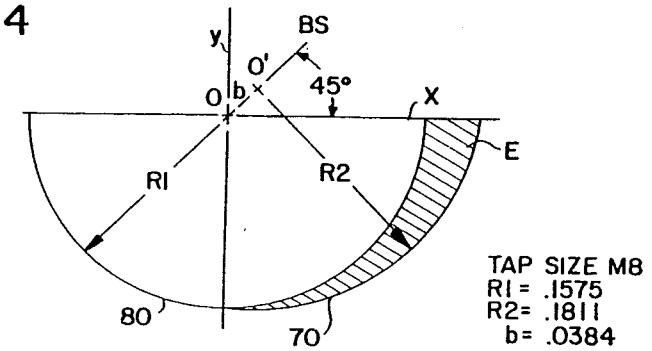

As illustrated in FIG. 4, a thread was formed in a semi-cylindrical jaw using an M8 tap size to form a thread with a radius R1=0.1575 inches. Under equations (2) and (5), the radius R2 of the thread relief is 0.1811 at a distance b along the bisector equal to 0.0384 inches. The thread relief E was obtained in the leading edge area of the jaw. No thread marking was evident when the jaw was used to screw the stud into a workpiece under high torque conditions.

EXAMPLE III

Figure 5:
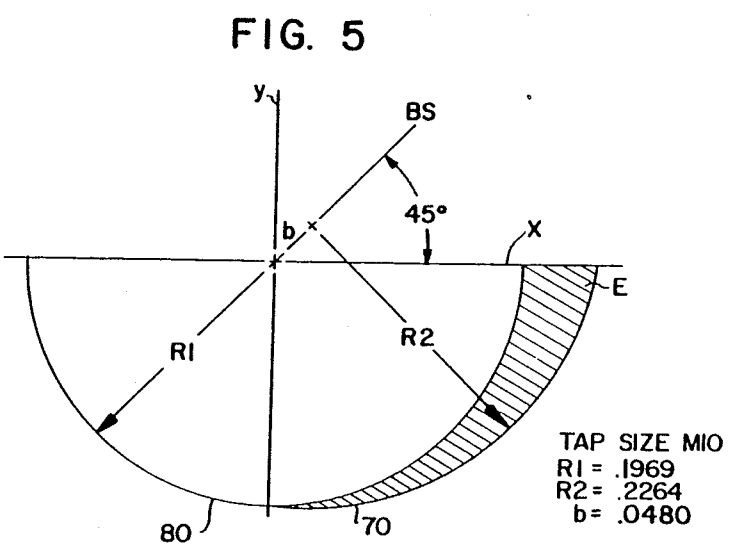
FIGS. 3, 4 and 5 are cross-sectional views of the thread relief in accordance with three examples of the invention.

As illustrated in FIG. 5, a thread formed in a semi-cylindrical jaw using an M10 tap size to form a thread with radius R1=0.1969 inches. In accordance with equations (2) and (5), the radius R2 of the thread relief is 0.2264 inches at a distance b along the bisector BS equal to 0.0487 inches. The thread relief E was accomplished in the leading edge area of the jaw. No thread markings were evident when the jaw was used to screw a stud into a workpiece under high torque conditions.

Figure 6:
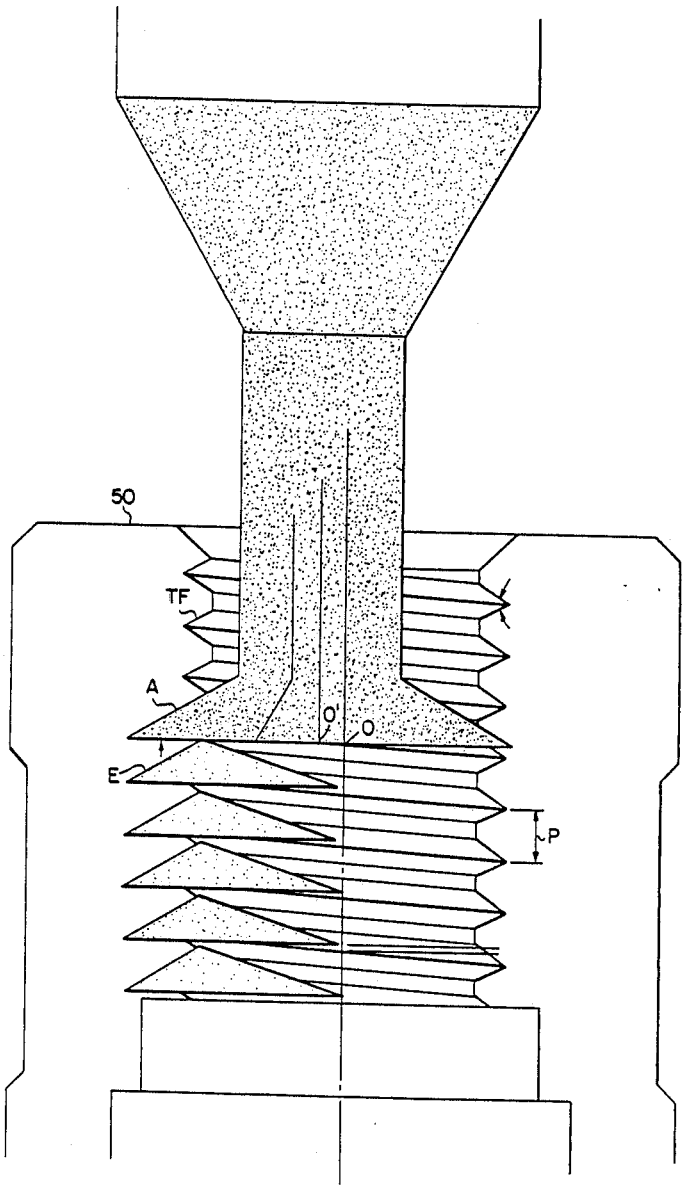
FIG. 6 is a top view of the jaw illustrated in FIG. 2 with a cutter located therein for forming the thread relief.

In the preferred embodiment, the thread relief is obtained by removing material from the thread with the cutter A. As illustrated in FIG. 6, the cutter A removes material in the leading edge area of the jaws, on the thread flank TF of the thread facing the workpiece. To this end, the cutter is selected based on equation (1) since the radius R1 of the thread is known. The cutter A is then positioned at the thread center point O and then moved through the distance b to the thread relief center point 0′ in accordance with equation (4). Material from the thread flank facing the workpiece is removed to obtain the thread relief E. The cutter is then withdrawn and moved one thread pitch D where it is repositioned in the same way for the next thread flank.

A modified dove tail cutter having a size matching the thread size can be used as the cutter to create the thread relief. While the aforementioned cutter is preferred, it is also possible to use a V-shaped wheel cutter, a rubber wheel with diamond cutters, or a fine jet carbide blaster for removing the material from the jaw.

The principles preferred embodiments, and modes of operation of the thread relief in accordance with the present invention has been described in the foregoing specification with respect to the preferred embodiment. The invention which is intended to be protected herein, however, is not to be construed as limited to the particular forms disclosed, since those forms are to be regarded as illustrative rather than restrictive. Variations and changes may be made by those skilled in the art without departing the spirit of the invention.

What is claimed is:

1. An automatic stud driver comprising:

a plurality of stud gripping and rotationally driven jaws, each of said jaws having a leading edge area and a trailing edge area with reference to a rotational direction of said jaws;

said plurality of jaws forming a substantially cylindrical assembly having a central longitudinal axis, a transverse cross-section of each jaw defining an arc of a circle having a thread center point located along said center longitudinal axis, said thread center point defining an intersection of first and second mutually orthogonal transverse axes, one of said transverse axes centrally dividing said arc to define said leading edge area and trailing edge area;

each of said jaws having an internal thread with a predetermined radius R1 originating from said thread center point;

only the leading edge area of each of said jaws having thread relief with a radius R2 originating from a thread relief center point located at a distance b from the thread center point in a direction away from the trailing edge area of said jaw;

wherein R2 and b satisfy the following equations:

$$R2=(0.75 \text{ to } 1.5)\times R1$$

$$b=(0.2 \text{ to } 0.5)\times R2.$$

2. The automatic stud driver of claim 1, wherein said stud driver includes two jaws, the transverse cross-section of each jaw defining a semicircle.

3. The automatic stud driver of claim 1, wherein the distance b is measured in the direction away from the trailing edge of said jaw along the bisector of said mutually orthogonal transverse axes.

4. The automatic stud driver of claim 1, wherein:

$$R2=1.15\times R1.$$

5. The automatic stud driver of claim 1, wherein:

$$b=0.212\times R2.$$

6. The automatic stud driver of claim 1, wherein:

$$R2=1.15\times R1$$

$$b=0.212\times R2.$$

7. The automatic stud driver of claim 1 wherein the thread relief creates a recess between the leading edge area and a stud inserted into said jaws under normal torque conditions, said leading edge area approaching said stud to decrease the size of said recess under high torque conditions, normal torque conditions being defined by an equation T=KDL wherein T is torque in inch pounds; K is the torque coefficient; D is the nominal stud diameter in inches; and L is the clamp load objective; and high torque conditions being a torque that exceeds the torque defined by the equation $T=KDL$.

8. An automatic stud drive for rotatably driving a threaded stud into a workpiece under normal torque and high torque conditions, normal torque conditions being defined by an equation T=KDL wherein T is torque in inch pounds; K is the torque coefficient; D is the nominal stud diameter in inches; and L is the clamp load objective; and high torque conditions being a torque that exceeds the torque defined by the equation $T=KDL$, said stud driver, comprising:

a plurality of threaded rotatable stud gripping jaws each having a leading edge area and a trailing edge area with reference to a direction of rotation of said jaws, the leading edge area of each jaw having thread relief to provide a recess between said leading edge area and said stud under normal torque conditions, said leading edge area approaching said stud to decrease the size of said recess under high torque conditions to reduce thread deformation in said stud.

9. The automatic stud driver of claim 8, wherein the thread relief increases a contact area between said leading edge area and said stud.

10. The automatic stud driver of claim 8 wherein only the leading edge area of the jaw has thread relief.

11. The automatic stud driver of claim 8, wherein the jaw has a thread with predetermined radius R1, and the thread relief in the leading edge area of the jaw has a radius R2 in the range of 75–150% of R1.

12. The automatic stud driver of claim 11, wherein the radius R1 of the thread originates at a thread center point, and the radius R2 of the thread relief originates at a thread relief center point offset from the thread center point in a direction away from the trailing edge area, the distance between the thread relief center point and the thread center point being 20–50% of R2.

13. A method for reducing the likeihood of thread deformation on a threaded stud grasped by a cylindrical assembly of jaws and rotated into a workpiece under high torque conditions, each jaw having a leading edge area and a trailing edge area with reference to a direction of rotation of said assembly of jaws, normal torque conditions being defined by an equation $T=KDL$ wherein T is torque in inch pounds; K is the torque coefficient; D is the nominal stud diameter in inches; and L is the clamp load objective; and high torque conditions being a torque that exceeds the torque defined by the equation $T=KDL$, said method comprising the step of:

providing thread relief at the leading edge area of each jaw by creating a recess between the leading edge area and the stud under normal torque conditions, said leading edge area approaching said stud to decrease the size of the recess under high torque conditions to increase contact area between the leading edge area and the stud.

14. The method of claim 13, wherein the step of providing thread relief includes providing the jaw with a predetermined thread having a radius R1 measured from a thread center point, providing thread relief with a radius R2 originating from a thread relief center point at a distance b offset from the thread center point in a direction away from the trailing edge area, and choosing the values from the radius R2 and the distance b in accordance with the following equations:

$$R2=(0.75 \text{ to } 1.5)\times R1$$

$$b=(0.2 \text{ to } 0.5)\times R2$$

15. The method of claim 14 wherein the thread center point defines two mutually orthogonal transverse axis, and the distance b between the thread center point and the thread relief center point is measured on the bisector of said axis.

16. The method of claim 13 wherein the step of providing thread relief includes creating a recess only at the leading edge area of each jaw.

* * * * *